US008100066B2

(12) United States Patent
Stein

(10) Patent No.: US 8,100,066 B2
(45) Date of Patent: Jan. 24, 2012

(54) HYBRID FEED MECHANISM

(76) Inventor: Peter Stein, Sidcup (GB)

( * ) Notice: Subject to any disclaimer, the term of this patent is extended or adjusted under 35 U.S.C. 154(b) by 239 days.

(21) Appl. No.: 12/295,590

(22) PCT Filed: Mar. 30, 2007

(86) PCT No.: PCT/GB2007/001150

§ 371 (c)(1),
(2), (4) Date: Sep. 30, 2008

(87) PCT Pub. No.: WO2007/113497

PCT Pub. Date: Oct. 11, 2007

(65) Prior Publication Data

US 2009/0173257 A1 Jul. 9, 2009

(30) Foreign Application Priority Data

Apr. 6, 2006 (GB) ..... 0606898.5

(51) Int. Cl.
*F23K 3/12* (2006.01)
*F23K 3/14* (2006.01)
*F23G 5/033* (2006.01)

(52) U.S. Cl. ..... 110/289; 110/109; 110/110; 110/222; 110/223; 414/198

(58) Field of Classification Search ..... 110/109, 110/110, 222, 223, 289, 290; 241/186.4; 414/198
See application file for complete search history.

(56) References Cited

U.S. PATENT DOCUMENTS

| | | | | |
|---|---|---|---|---|
| 4,650,546 | A * | 3/1987 | Le Jeune | 110/223 |
| 4,658,591 | A * | 4/1987 | Alvarez | 110/224 |
| 4,787,321 | A * | 11/1988 | Schnellbacher et al. | 110/258 |
| 5,022,330 | A * | 6/1991 | Burgher et al. | 110/223 |
| 5,257,586 | A | 11/1993 | Davenport | |
| 6,067,915 | A | 5/2000 | Sharpe | |
| 7,743,717 | B2 * | 6/2010 | Vera | 110/223 |
| 2004/0052724 | A1 | 3/2004 | Sorace | |

FOREIGN PATENT DOCUMENTS

| | | | |
|---|---|---|---|
| EP | 1736527 | A1 | 12/2006 |
| FR | 2760524 | A1 | 9/1998 |
| GB | 710999 | | 6/1954 |
| SU | 982767 | A1 | 12/1982 |
| WO | WO-2004074409 | A1 | 9/2004 |

OTHER PUBLICATIONS

PCT International Search Report (dated Jul. 18, 2007), International Application No. PCT/GB2007/001150, International Filing Date Mar. 30, 2007, ( 3 pages).
Russian Office Action, Application No. 2008143981/03 (057373), Application Filing Date Mar. 30, 2007, Corresponding to PCT/GB2007/001150—Filed Mar. 20, 2007, Applicant—Peter Stein (with Translation), (7 pages).

* cited by examiner

*Primary Examiner* — Kenneth Rinehart
*Assistant Examiner* — David J Laux
(74) *Attorney, Agent, or Firm* — Blakely, Sokoloff, Taylor & Zafman LLP

(57) ABSTRACT

A feed mechanism in which a ram (2) fed from a hopper (1) compresses a fuel against a closed valve (11) which is then opened for the ram to push the fuel towards a rotary scroll (6) for delivery to a processing vessel.

3 Claims, 4 Drawing Sheets

HYBRID FEED MECHANISM

The present patent application is a non-provisional application of International Application No. PCT/GB2007/001150, filed 30 Mar. 2007, and further claims priority to United Kingdom Application No. GB0606898.5, filed 6 Apr. 2006.

Conventional ram feeders used to inject a fuel into a processing vessel have a problem with certain fuel types having a tendency to compact in a manner that jams the feeder and stops the flow of fuel into the vessel. This is particularly a problem with larger ram units and can result in serious process problems. The present invention has been designed to provide a solution to this problem with particular regard to the feeding of fuels into a rotating anaerobic gasifier vessel. However, other the feed mechanism is not limited to use in gasifiers. Fuel is compressed by a ram against a closed valve to form a pellet which acts as a compact fuel and also a barrier to prevent ingress of air. In certain cases it may be necessary to provide a cutter, preferably a rotary cutter between the guillotine valve and the scroll tube to break up the fuel pellet and assist the delivery of fuel into the scroll feeder. However, a preferred version of the invention incorporates a chamber between the ram feeder and the scroll feeder to receive the fuel from one or more ram feeders before delivery to the scroll feeder to assist in the fuel breakdown process. The introduction of this chamber in most cases obviates the need for a rotary cutter. It must be noted that the feeder mechanism is not limited to feeding a gasifier, but can be used in a wide variety of process vessels. A further benefit is that more than one ram can be incorporated to increase or vary the fuel supply and even out its flow.

By way of example only, a specific embodiment of the present invention with and without an intermediate chamber will now be described with reference to the accompanying drawings in which.

Figure 1:
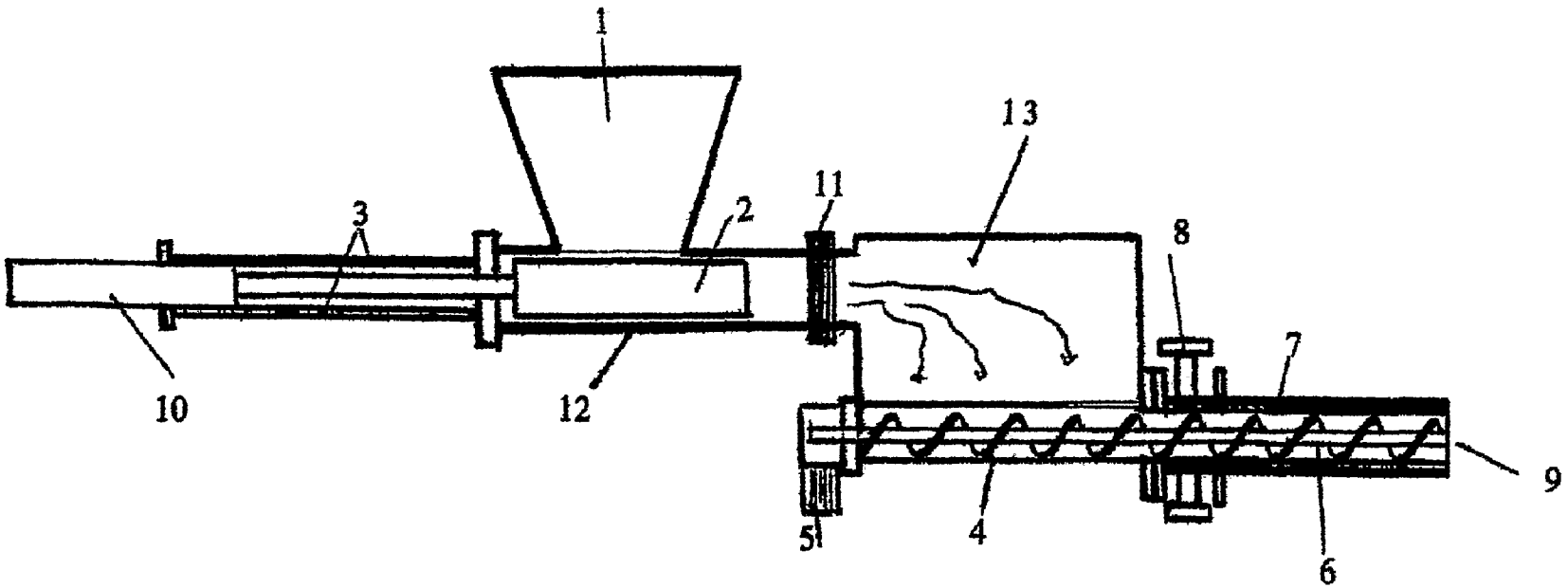
FIG. 1 is a side view of the feeder mechanism with intermediate chamber and single ram feed.
Figure 2:
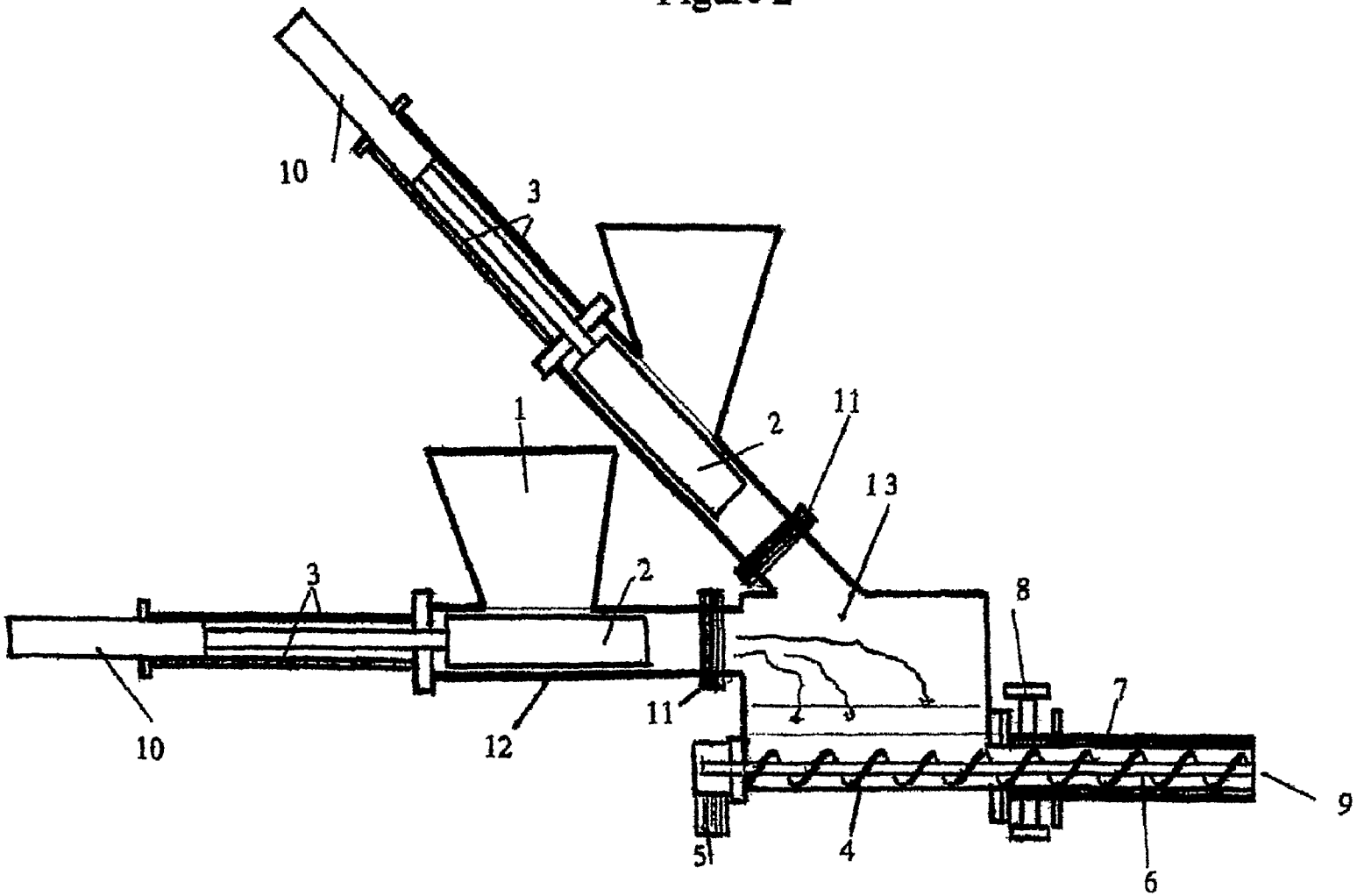
FIG. 2 is a side view of the feeder mechanism with intermediate chamber and two ram feeds.
Figure 3:
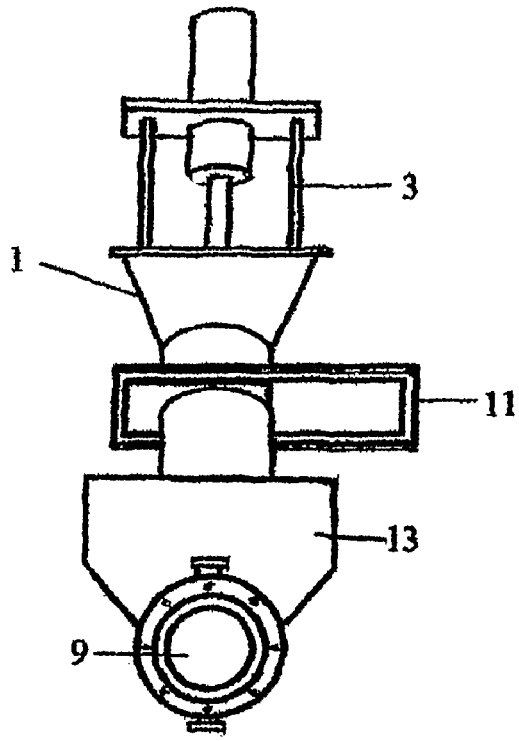
FIG. 3 is a view from the outlet end of the feeder mechanism with intermediate chamber.
Figure 4:
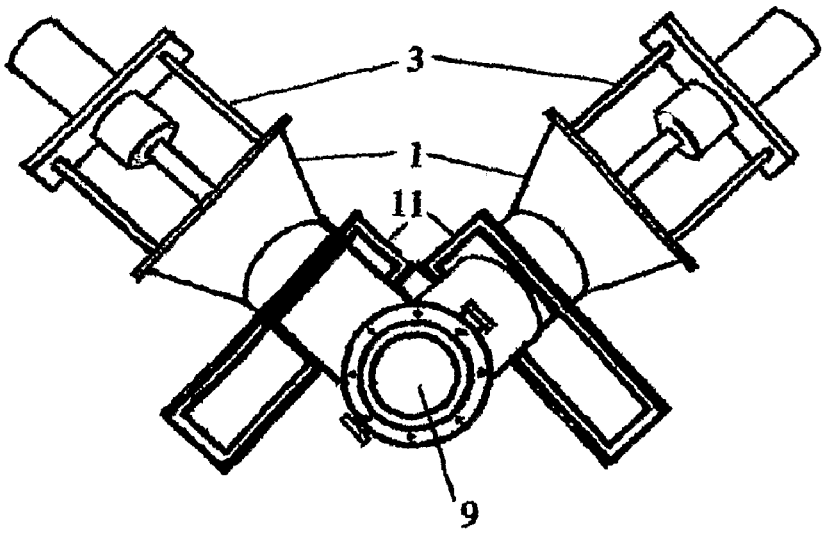
FIG. 4 is a similar view of a feeder with two rams feeding a single scroll, one open one closed without intermediate chamber.
Figure 5:
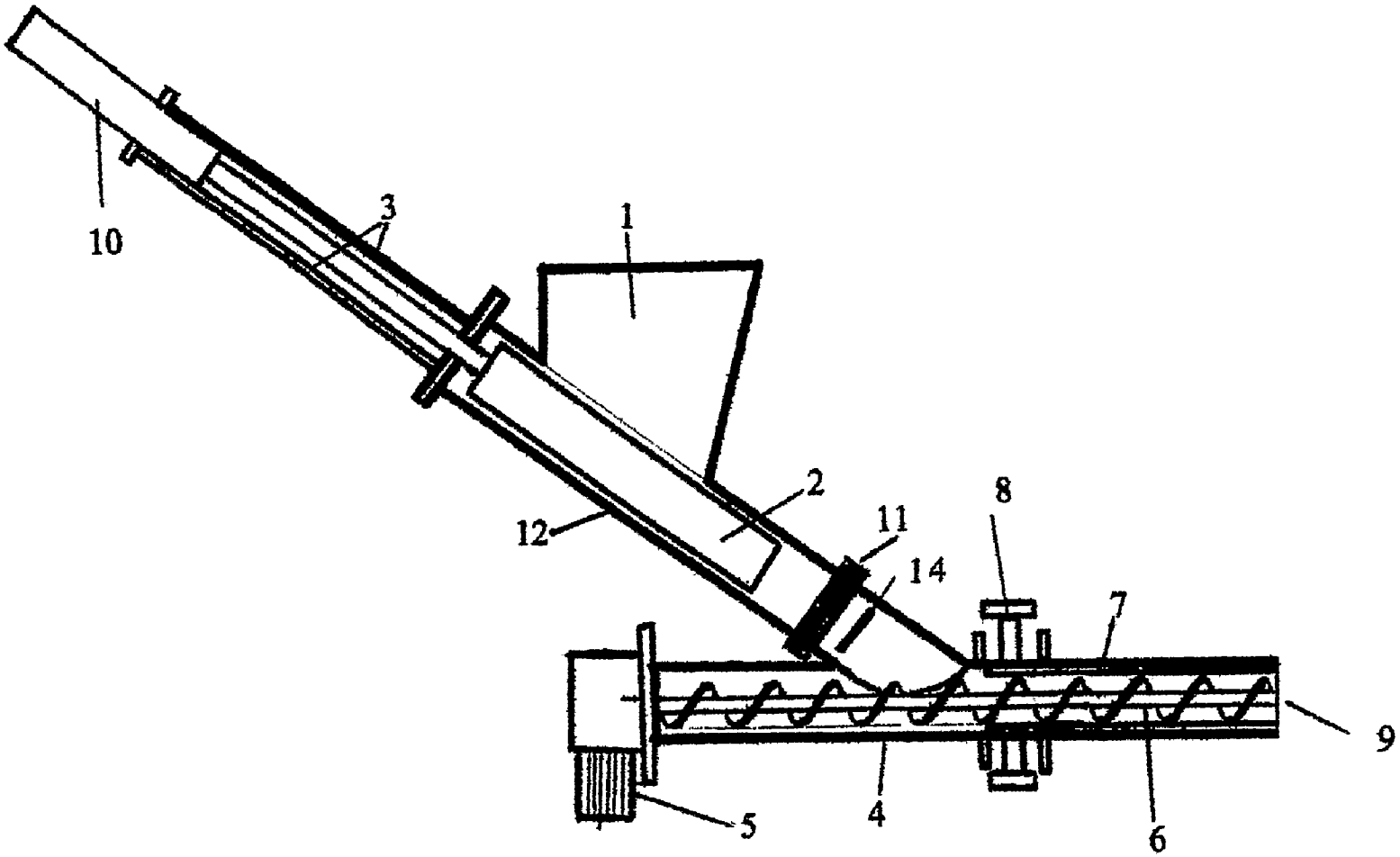
FIG. 5 is a side view of a feeder without intermediate chamber.

Shredded and dried fuel is delivered into a feed hopper 1 whence it is gravity fed into a ram tube 12 whilst the feeder ram 2 is retracted by a hydraulic ram 10 along guides 3. The feeder ram 2 is returned to press the fuel charge against a closed guillotine valve 11. The guillotine valve then opens and the fuel pellet is pushed by the feeder ram towards the scroll tube 4 containing scroll 6 driven by a power unit 5 Because of the high temperature in the gasifier retort, the part of the feeder inserted into the gasifier is cooled by water introduced through inlet 8 into a cooling jacket 7. The fuel is ejected from the scroll drive at the tube end 9 into the gasifier. In the preferred embodiment of the invention, an intermediate chamber (13) is provided between the ram feeder and the scroll More than one feed ram can be connected to the intermediate chamber or scroll feeder, and this gives the advantage of a possible variation of fuel supply and a smoothing of flow of fuel to the scroll. In addition, a rotary cutter (14) can be fitted between the guillotine valve and the scroll tube to improve the fuel flow Whilst the invention has been described in terms of a specific embodiment thereof, it will be apparent that various changes and modifications can be made by one skilled in the art without departing from the spirit and scope thereof.

The invention claimed is:

1. A feed mechanism in which a ram fed from a feed hopper is configured to compress a shredded and dried fuel against a closed valve which is then opened for the ram to push the fuel to fall into an intermediate chamber, provided in the feed mechanism between the valve and a rotary scroll feeder of the feed mechanism to assist the break up of the fuel before entry of the shredded and dried fuel to the rotary scroll feeder for delivery to a heated rotary anaerobic gasifier vessel, the length of the ram being such as to close the base of the feed hopper and thus prevent fuel entering behind the ram when in the extended position, and open the base of the feed hopper when in the retracted position, wherein an outlet pipe of the rotary scroll feeder, configured for insertion into the heated rotary anaerobic gasifier vessel, is provided with a cooling jacket having an inlet through which water for cooling the outlet pipe is introduced into the cooling jacket.

2. A feed mechanism as claimed in claim 1 in which the valve is a sliding guillotine valve.

3. A feed mechanism as claimed in claim 1 or 2 in which there are two or more rams connecting to a single intermediate chamber.

* * * * *